US005954160A

United States Patent [19]

Wells, Sr. et al.

[11] Patent Number: 5,954,160

[45] Date of Patent: Sep. 21, 1999

[54] WHEEL ENGAGING VEHICLE LIFT

[75] Inventors: Rickey D. Wells, Sr., Broadalbin; Ronald W. Veresko, Schenectady, both of N.Y.

[73] Assignee: Mohawk Resources Ltd., Amsterdam, N.Y.

[21] Appl. No.: 08/758,650

[22] Filed: Nov. 27, 1996

[51] Int. Cl.[6] ..... B66F 7/28; B66F 7/00

[52] U.S. Cl. ..... 187/219; 187/203; 187/210; 254/89 H; 414/427

[58] Field of Search ..... 187/219, 220, 187/216, 210, 203; 414/427, 563, 253; 254/89 H, 134

[56] References Cited

U.S. PATENT DOCUMENTS

| | | | |
|---|---|---|---|
| 2,786,549 | 3/1957 | Tozloski | 187/219 |
| 3,182,829 | 5/1965 | Wagner | 414/563 |
| 3,724,602 | 4/1973 | Hernick . | |
| 3,830,387 | 8/1974 | Virnig | 414/427 |
| 4,196,887 | 4/1980 | Tsujimura | 254/89 H |
| 4,225,117 | 9/1980 | Suzuki | 254/89 H |
| 4,267,901 | 5/1981 | Tsujimura | 187/8.54 |
| 4,545,462 | 10/1985 | Sul | 187/8.41 |
| 4,763,761 | 8/1988 | McKinsey et al. | 187/8.41 |
| 4,793,763 | 12/1988 | Bubik | 414/563 |
| 4,825,977 | 5/1989 | Isogai | 187/203 |
| 4,892,028 | 1/1990 | Stivers | 91/517 |
| 4,968,052 | 11/1990 | Alm et al. | 414/563 |
| 5,184,930 | 2/1993 | Kuhn | 414/427 |
| 5,352,083 | 10/1994 | Roberts et al. | 414/563 |
| 5,362,196 | 11/1994 | Beattie et al. | 414/785 |
| 5,484,134 | 1/1996 | Francis | 254/2 B |

FOREIGN PATENT DOCUMENTS

| | | | |
|---|---|---|---|
| 678669 | 7/1939 | Germany | 254/134 |
| 755405 | 8/1956 | United Kingdom | 187/219 |

OTHER PUBLICATIONS

"What makes a Mohawk a Mohawk," Mohawk Industrial Park, Amsterdam, NY.

"9000 LB. Clear Floor Lift—Model System I—The System Built To Last A Lifetime," Mohawk Resources Ltd., Amsterdam, NY (Sep. 1994).

"12,000 & 15,000 LB. Capacity Lifts—Models LMF–12 & TP–15—Lifts to Higher Standards," Mohawk Resources Ltd., Amsterdam, NY (Sep. 1994).

*Primary Examiner*—Janice L. Krizek
*Assistant Examiner*—Thuy V. Tran
*Attorney, Agent, or Firm*—Heslin & Rothenberg, P.C.

[57] ABSTRACT

A wheel engaging vehicle lift for raising a vehicle relative to the ground and for supporting the vehicle in a raised position includes first and second support columns standing vertically upward from the ground. A first carriage is movably attached to the first support column and a second carriage is movably attached to the second support column. A first pair of arms extend away from the first carriage and a second pair of arms extend away from the second carriage, wherein the first and second pairs of arms are each rotatable about a substantially vertical axis proximate to a first end of the arms. A wheel engaging adapter may be removably secured proximate to an opposite end of the first and second pairs of arms, wherein the adapters are each rotatable about a substantially vertical axis proximate to the second end. The structure of the invention enables a conventional two-post frame engaging lift to be easily and readily converted into a two-post wheel engaging vehicle lift, and vice versa.

20 Claims, 7 Drawing Sheets

WHEEL ENGAGING VEHICLE LIFT

BACKGROUND

1. Technical Field

The present invention generally relates to lifting devices. More particularly, the present invention relates to vehicle lifting devices. Even more particularly, the present invention relates to vehicle lifting devices which are easily and readily convertible between a frame engaging lift to a wheel engaging lift, and vice versa.

2. Background Information

There are numerous devices available on the market today for lifting vehicles off the ground so that maintenance and service can be performed thereon. In addition to traditional in-ground vehicle lifts, other common lifts include above-ground frame engaging lifts and above-ground mobile column wheel engaging lifts.

Conventional frame engaging vehicle lifts include two vertically oriented posts or support columns, wherein each post includes a pair of arms which extend horizontally therefrom. At the free end of each of the arms is a frame contact pad for engagement to the underside of the vehicle for support thereof. Positioning of the lift arms can be achieved not only by longitudinally extending or retracting the telescoping tubes which form the lift arms, but also by swinging the arms about a substantially vertical pivot point. In accordance with this structure, the contact pads can be strategically engaged to locations on the underside of the vehicles, thus facilitating lifting and preventing vehicle damage. Once the vehicles are lifted, the desired maintenance and service tasks can be performed. For more information regarding the construction and operation of high quality above-ground frame engaging vehicle lifts, refer to the 20-page booklet of the assignee of the present invention, Mohawk Resources Ltd., PO Box 110, Mohawk Industrial Park, Amsterdam, N.Y., entitled, "What Makes a Mohawk a Mohawk," the disclosure of which is hereby incorporated by reference in its entirety. Moreover, further information regarding Mohawk Resources Ltd. frame engaging lifts can be found in the following product literature: Model A-7 (7,000-lb asymmetric lift) (Rev. 9/96), Model System 1 (9,000-lb clear floor lift) (Rev. 9/94), and Models LMF-12 & TP-15 (12,000 & 15,000-lb capacity lifts) (Rev. 9/94), all of which are expressly incorporated by reference in their entireties.

However, electric vehicles pose significant frame access problems for conventional frame contacting lifts because of large and bulky battery and external storage packs which are attached to the underside of such vehicles. Other alternate fuel vehicles, such as natural gas and propane vehicles, also present the same frame access problems. Therefore, above-ground frame engaging vehicle lifts are generally not properly adapted for use with alternate fuel vehicles. Also, another problem associated with above-ground frame engaging vehicle lifts is the timely setup required to properly engage the contact pads to the underside of the vehicles.

An alternative to above-ground frame engaging lifts—suitable to safely handle alternate fuel vehicles—are above-ground mobile column wheel engaging lifts. However, mobile column lifts require a post or column for each wheel of the vehicle. Therefore, if the vehicle includes four wheels, four separate posts are required. In order to employ such a wheel engaging lift, each post is moved on the shop floor and positioned next to a corresponding wheel of a vehicle. After the four posts are positioned and the corresponding wheels engaged, the vehicle can be lifted so that maintenance and repair can be performed. Yet, because four posts are generally required in such systems, the downside is added cost and the need for additional floor space. Moreover, because four posts are usually required, these systems are more prone to malfunction, thereby resulting in increased maintenance costs.

Thus, a need exists for a wheel engaging vehicle lift which contains a solution to all of the aforementioned problems.

SUMMARY OF THE INVENTION

Briefly, the present invention satisfies this need and overcomes the shortcomings of the prior art through the provision of a wheel engaging vehicle lift, which may include first and second support columns standing vertically upward from the ground. A first carriage may be movably attached to the first support column and a second carriage may be movably attached to the second support column. A first pair of arms may extend away from the first carriage and a second pair of arms may extend away from the second carriage, wherein the first and second pairs of arms are each rotatable about a substantially vertical axis proximate to a first end of the arms. A wheel engaging adapter may be removably secured proximate to an opposite end of the first and second pairs of arms, wherein the adapters are each rotatable about a substantially vertical axis proximate to the second end.

It is therefore a primary object of the present invention to provide a vehicle lift which enables a conventional two-post frame engaging lift to be easily and readily converted into a two-post wheel engaging vehicle lift, and vice versa.

It is another object of the present invention to provide a wheel engaging vehicle lift which can be safely and reliably adapted to lift alternate fuel vehicles, such as electric cars.

It is yet another object of the present invention to provide a vehicle lift which maintains its capability as a frame engaging lift so that tasks such as wheel repair and maintenance can performed.

It is still another object of the present invention to provide a vehicle lift which can accommodate a wide variety of vehicle wheel bases and lengths.

It is yet another object of the present invention to provide a wheel engaging vehicle lift which reduces the setup time required to engage the vehicle, in comparison to the setup time of the conventional frame engaging lift.

It is another object of the present invention to provide a versatile two-post vehicle lift which conserves valuable floor space.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description taken in conjunction with the accompanying drawings, in which:

DESCRIPTION

It will be readily apparent that the components of the present invention, as generally described and illustrated in the figures, could be arranged and designed in a wide variety of different configurations. Thus, the following detailed description of the presently preferred embodiments of the wheel engaging vehicle lift of the present invention, as represented in FIGS. 1–8, is not intended to limit the scope of the invention, as claimed, but is merely representative of the presently preferred embodiments of the invention. The presently preferred embodiments of the invention will be best understood by reference to the drawings, where like parts are designated with like numerals.

Figure 1:
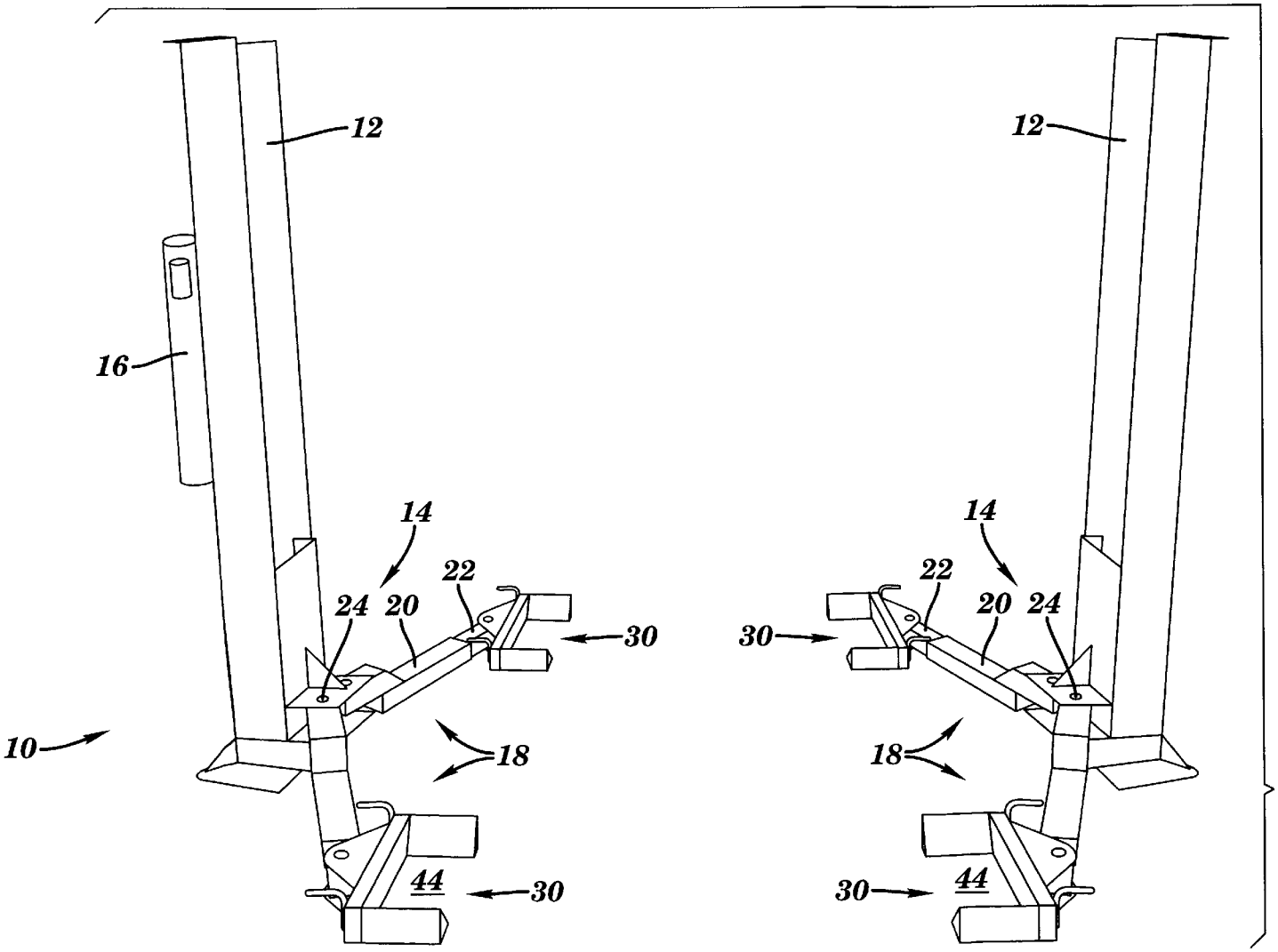
FIG. 1 is a front perspective view illustrating a portion of a wheel engaging vehicle lift constructed in accordance with the principles of the present invention.

In reference now to the drawings, and more particularly to FIG. 1, there is shown in accordance with the principles of the present invention, one embodiment of a wheel engaging vehicle lift 10. As depicted in FIG. 1, the main elements of lift 10 may include two support posts or columns 12, both standing vertically upright and spaced apart from one another a selected distance so that a vehicle may be positioned therebetween. A carriage 14 may be attached to each column 12, and by means of an actuator, e.g., hydraulic pump 16 and electric motor (not shown), or by any other known means, each carriage 14 may be moved vertically upwardly or downwardly relative to its associated column 12.

A pair of arms 18, i.e., two swing arms, may extend longitudinally away from each carriage 14. Each arm 18, in the preferred embodiment, comprises an outer tube 20 and an inner tube 22. As is known in the art, inner tube 22 may be slidably inserted inside outer tube 20 so as to form a tubular telescoping arrangement, depicted best in FIGS. 2, 5 and 7. The telescoping arrangement of tubes 20, 22 facilitates the adjustment of the length of each arm 18, which in turn facilitates the proper positioning of arms 18 of the wheel engaging vehicle lift 10 during setup.

Outer tube 20 and inner tube 22 have been illustrated as hollow tubes which are square in cross section. For purposes of economy of manufacture and structural integrity, hollow square tubing is preferred. However, in lieu thereof, tubes which are circular in cross section may be constructed for satisfactory performance.

As illustrated in the figures, each arm 18 may include a first end and a second end, with the first end of each arm 18 being pivotally secured to its associated carriage 14 through the provision of a hinge pin 24. Upper and lower reinforcing plates 26, 27 (see FIG. 2) of carriage 14 may include aligned apertures 28 formed therethrough for accepting pin 24. Preferably, the first end of each arm 18 includes a bore (not shown) for accepting pin 24. The first end of each arm 18 may be disposed between upper and lower reinforcing plates 26, 27, with pin 24 passing through aligned apertures 28 and the bore through arm 18, thereby facilitating easy rotation of each arm 18. The zone of rotation which arms 18 may take is illustrated in phantom in FIG. 3.

At the second end, i.e., the free end, of each arm 18, a wheel engaging adapter 30 may be removably attached thereto. In order to achieve the removable attachment, a bore 31 is formed proximate to the second end of each arm 18. Bore 31 is the same aperture employed in connecting contact pads (not shown) of a conventional frame engaging vehicle lift thereto. By adapting wheel engaging adapter 30 for removable attachment, the wheel engaging vehicle lift 10 of the present invention can be easily and readily converted between a frame engaging vehicle lift and a wheel engaging lift. It should be noted that a significant feature of the present invention is the ability to easily and readily convert a conventional frame engaging lift into a wheel engaging lift, without the need for any structural modification to the conventional frame engaging lift. In order to effect the conversion from a frame engaging lift to a wheel engaging lift, the conventional contact pads are simply removed from the second ends of the arms, and replaced with the wheel engaging adapters as described herein.

While any known means may be employed to effect the pivot motion of wheel engaging adapters 30, it is preferred that each wheel engaging adapter 30 may be secured to corresponding arm 18 for rotation about a substantially vertical axis through the provision of a pivot pin 32.

Figure 2:
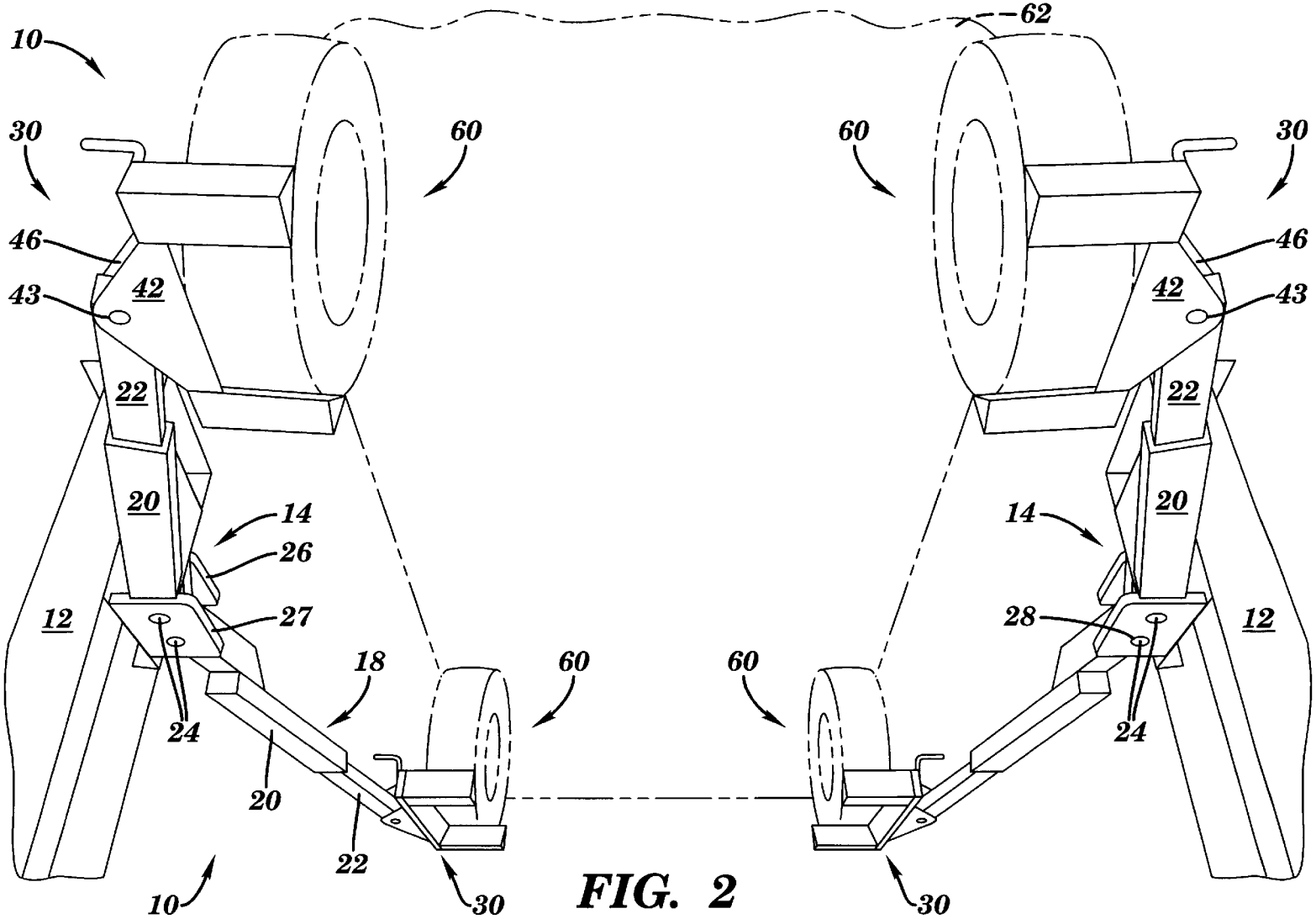
FIG. 2 is another perspective view, illustrating the underside of a vehicle, in phantom, being supported by the wheel engaging vehicle lift of the present invention.

In the preferred embodiment, and as shown in FIGS. 1 & 2, there are a total of four wheel engaging adapters 30 for engaging four wheel/tire assemblies 60 of a vehicle 62. In reference now to FIGS. 5–8, each wheel engaging adapter 30 may include two tubular members, i.e., a first tubular member 34 and a second tubular member 36. In the preferred embodiment, tubular members 34, 36 are both triangular in cross-section, and are arranged substantially parallel to one another with an open space 44 therebetween. A connecting member 38, such as a rectangular tubular member, may be employed to connect tubular members 34, 36 to one another in substantially parallel relationship.

First tubular member 34 may include a contact surface 35 and second tubular member 36 includes a contact surface 37. During operation, contact surfaces 35, 37, may engage tires 60 for lifting of vehicle 62 (see FIG. 2). The triangular shape of tubular members 34, 36 creates an angled surface for contact surfaces 35, 37, which facilitates contact with tires 60 during operation.

An upper plate 40 and a lower plate 42 may extend away from the top and bottom, respectively, of connecting member 38. A channel 46 (illustrated in FIG. 2) is formed between upper plate 40 and lower plate 42. As illustrated from the top in FIG. 6, plates 40, 42 may each resemble a triangular plate, with axially aligned holes passing therethrough. Preferably, lower plate 42 includes a threaded hole 43.

In order to facilitate removable attachment of pivot pin 32 to the second end of each arm 18, the lower end of pivot pin 32 may be threaded for threadable engagement to threaded hole 43 of lower plate 42. Moreover, the upper end of pivot pin 32 may include a head, which facilitates manual rotation of pin 32 with a hand tool (not shown) and prevents pin 32 from falling through the aligned holes and bores. Each wheel engaging adapter 30 may be removably secured proximate to the second end of each arm 18 by easily inserting pivot pin 32 through hole 41 in upper plate 40, through bore 31 formed through the second end of arm 18, and through hole 43 in lower plate 42.

Because of the heavy loads associated with raising vehicles, tubular members 34, 36 may be cambered or angled such that their free ends are disposed higher than their ends which are attached to connecting member 38. By introducing a camber or angle for tubular members 34, 36 (FIG. 8) once the vehicle is lifted, the members will become horizontally level. If no such camber were provided, a sagging effect would occur because of the weight of the vehicle. Any method of providing the camber or angle may be employed in this invention.

Figure 3:
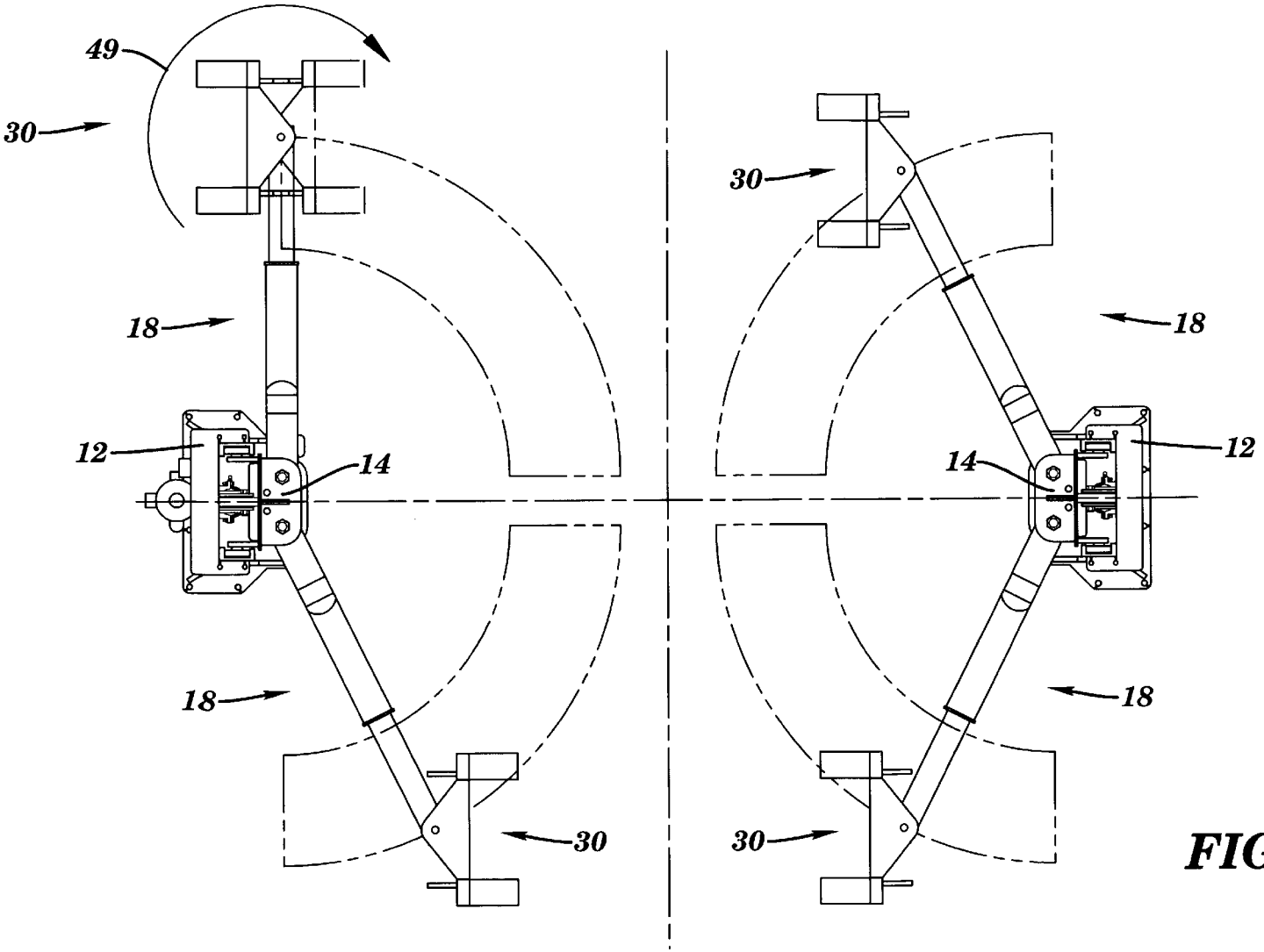
FIG. 3 is a top view of the wheel engaging vehicle lift of the present invention, illustrating in phantom the zone of rotation that a plurality of arms of the present invention may take during operation, also illustrating by arrow the rotation a plurality of wheel engaging adapters may take during operation.
Figure 4:
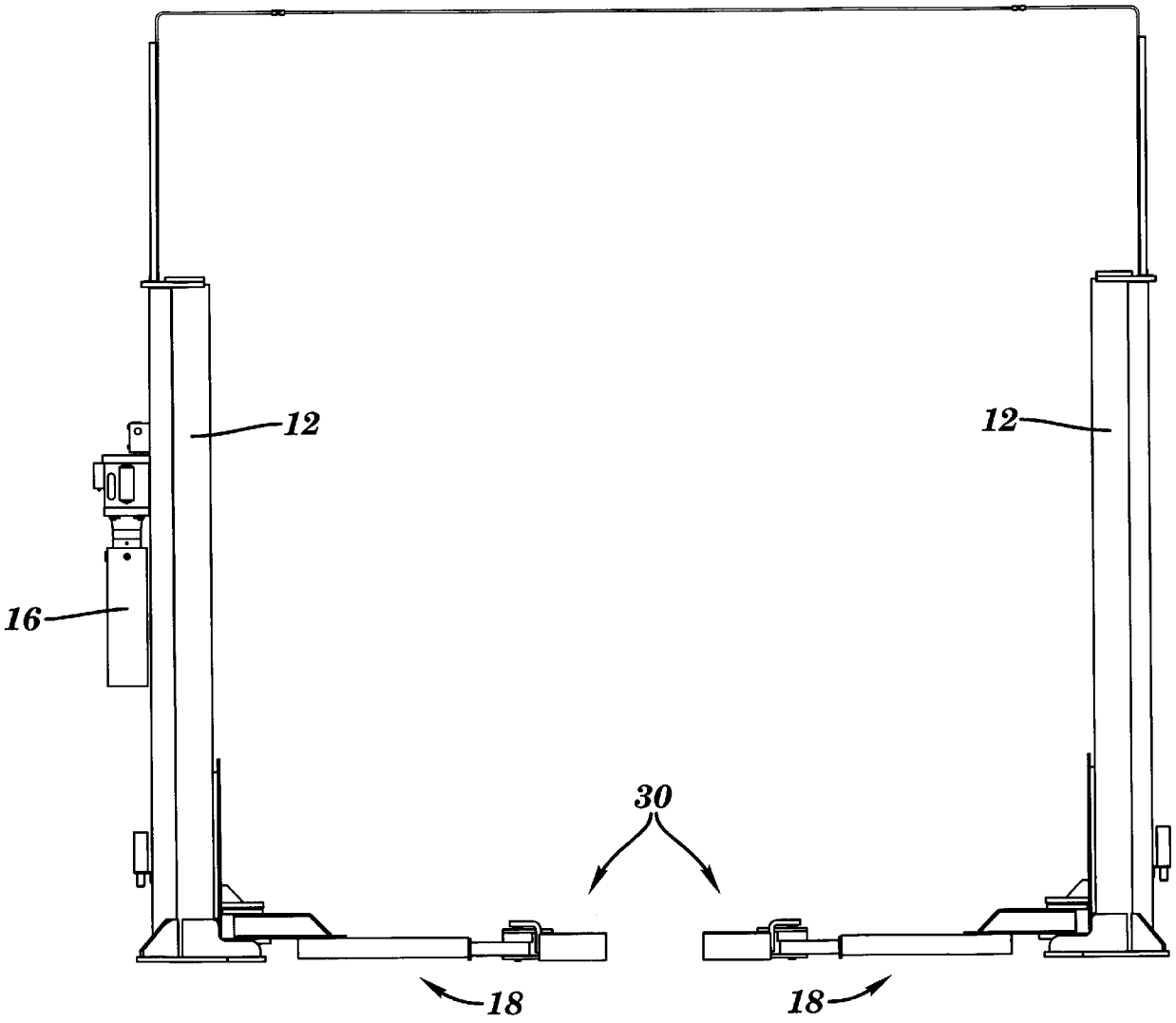
FIG. 4 is a front view of the wheel engaging vehicle lift of the present invention.

Each wheel engaging adapter 30 may include one or more handles 48 attached thereto for facilitating manual rotation of each adapter about pivot pin 32. A significant aspect of the present invention is the capability to rotate the plurality of wheel engaging adapters 30 about a substantially vertical axis so as to easily and readily locate the adapters for engagement to tires 60. As can be seen in FIG. 3, arrow 49 illustrates the rotational motion that each wheel engaging adapter 30 may take.

The wheel engaging adapters 30 of the present invention may be configured for receiving specific wheel diameters between the first and second contact surfaces 35, 37. For instance, one category of wheel engaging adapters 30 may be configured for receiving tires having diameters ranging from between 13 and 16 inches. Thus, a whole variety of wheel engaging adapters may be designed for accommodating a wide variety of differing wheel diameters.

Figure 5:
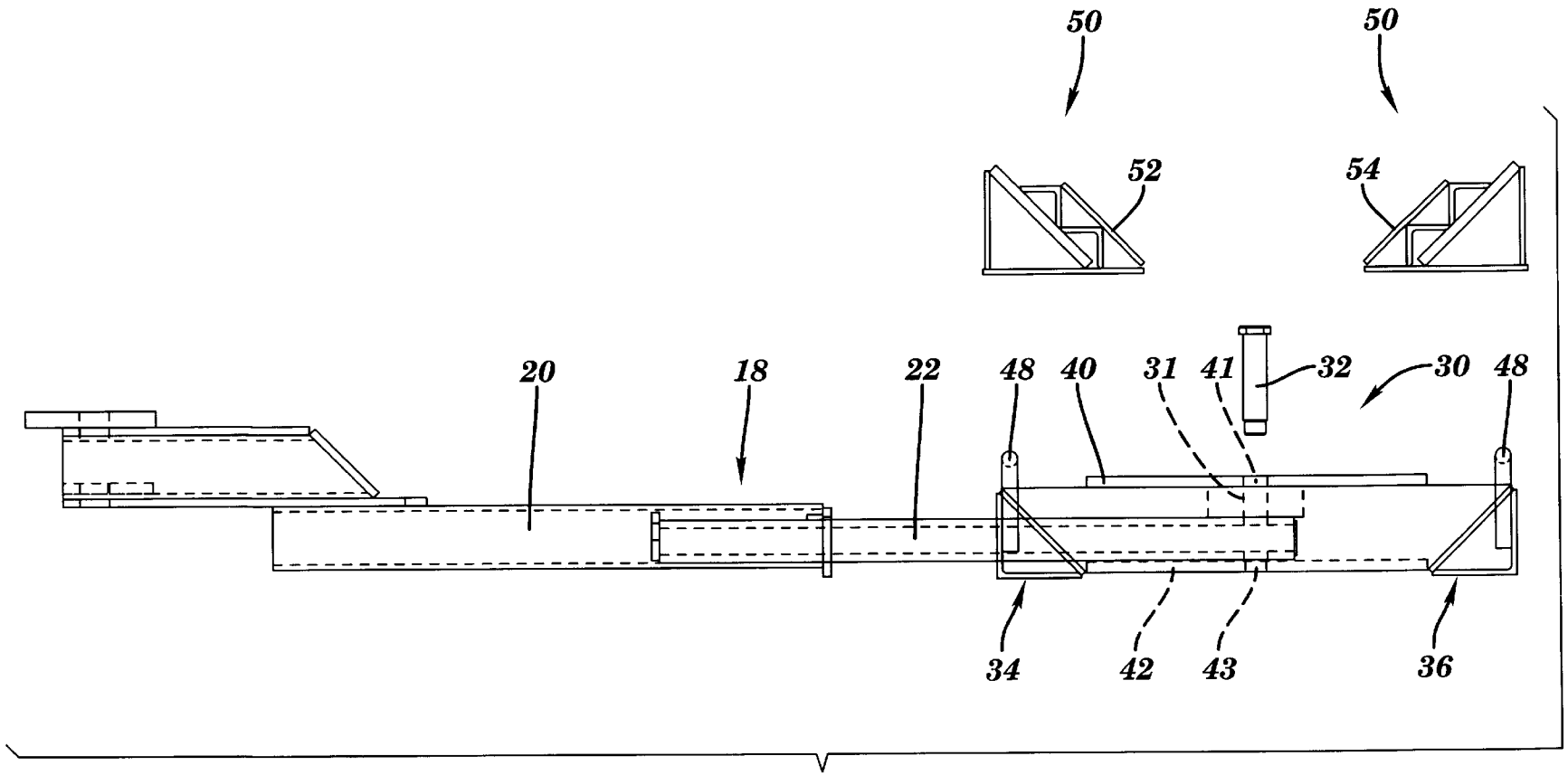
FIG. 5 is an enlarged and partially exploded side view illustrating in detail the arm, wheel engaging adapter and a pivot pin of the present invention, also showing additional attachment units disposed above the wheel engaging adapters which can be slidably attached to the adapters for accommodating tires having smaller diameters.
Figure 6:
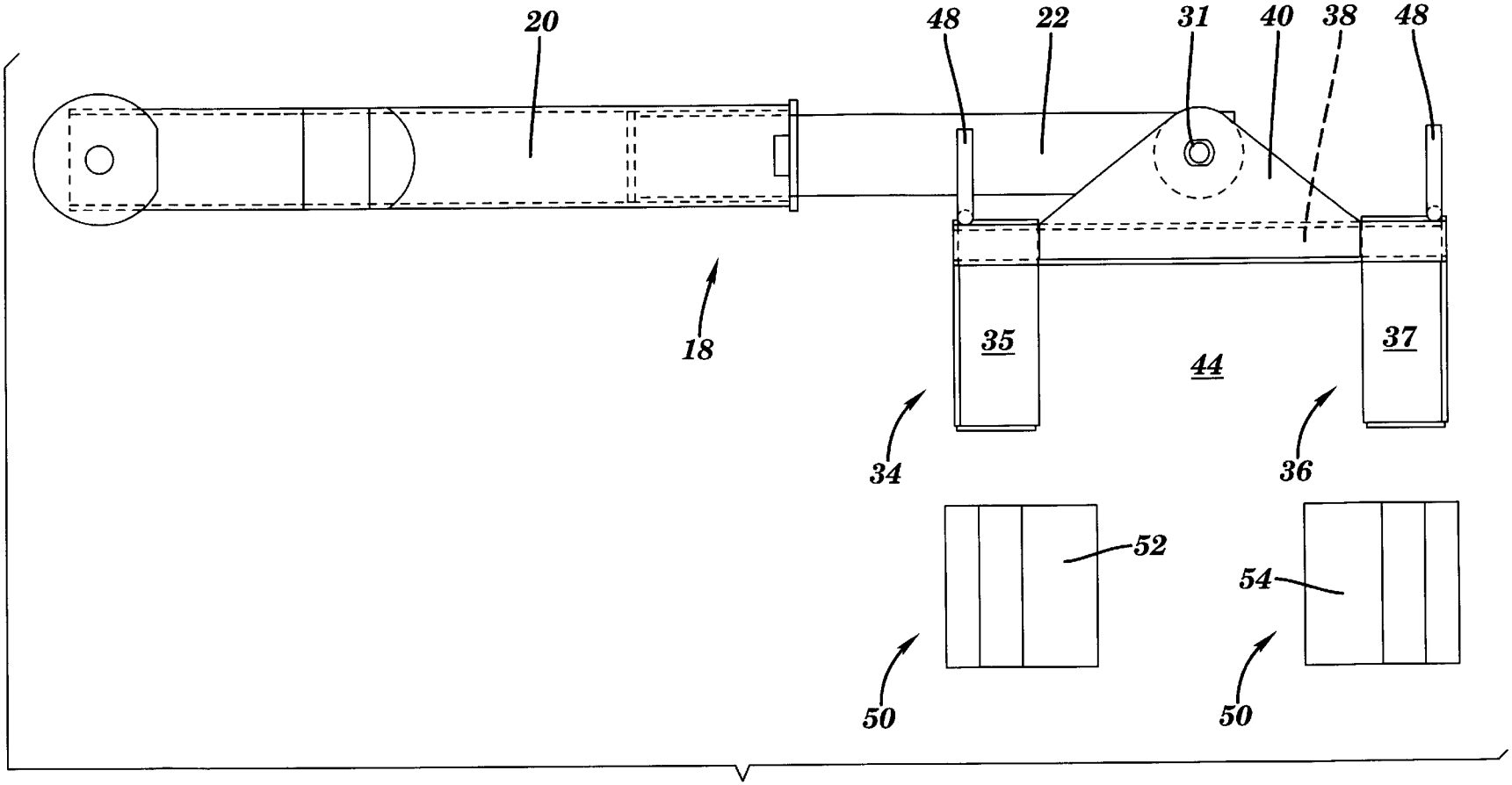
FIG. 6 is a top view illustrating the arm, wheel engaging adapter and attachment units of FIG. 5.

Alternatively, in order to accommodate tire diameters smaller than the range set forth by a specific tire engaging wheel adapter, an attachment unit 50 may be employed for adjusting the distance separating first contact surface 35 and second contact surface 37. Specifically, attachment unit 50, as shown in FIGS. 5 & 6, may be shaped as a triangular tubular member for being slidably received by existing tubular members 34, 36. A reduction in the distance separating the contact surfaces may thus be achieved by providing new contact surfaces 52, 54, both of which are disposed closer to one another for accommodating smaller diameter tires.

Figure 8:
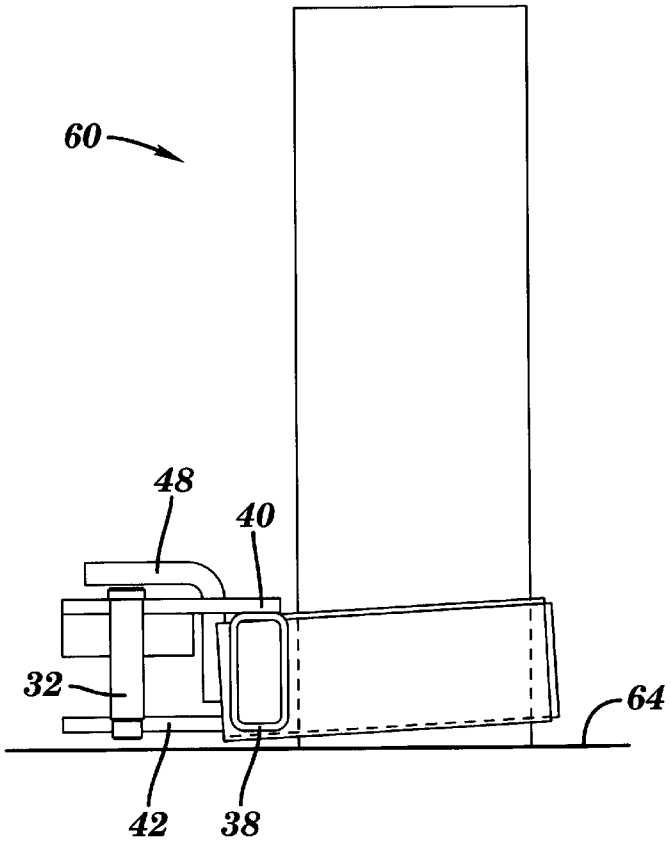
FIG. 8 is a front view illustrating the wheel engaging adapter and the tire of the present invention of FIG. 7.
Figure 7:
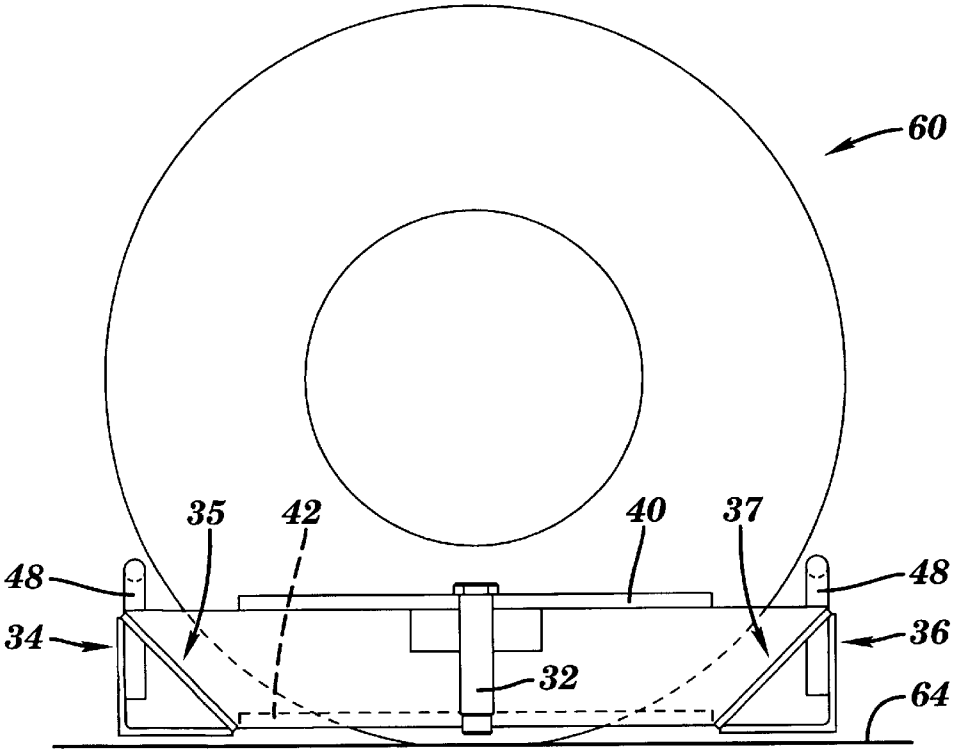
FIG. 7 is a side view illustrating a tire/wheel assembly resting on the ground without being engaged by the wheel engaging adapter.

FIGS. 7 and 8 illustrate a tire 60 resting on the ground 64, with first and second contact surfaces 35, 37 disposed outside of the threads of tire 60. During operation, a mechanic or other personnel will centrally locate vehicle 62 between two posts 12. After the wheel engaging adapters 30 are properly positioned around wheels 60, the vehicle may be lifted off the ground.

While several aspects of the present invention have been described and depicted herein, alternative aspects may be effected by those skilled in the art to accomplish the same objectives. For example, while a total of four wheel engaging adapters is illustrated throughout this specification, any number of adapters can be used. Also, the present invention may be used as a combination wheel engaging lift and a frame engaging lift, i.e., both contact pads and wheel adapters may simultaneously be used in lifting a vehicle. Furthermore, in order to accommodate an entire host of different wheel/tire assembly diameters, any structural means may be provided which modifies the distance separating the respective tire contact surfaces. Accordingly, it is intended by the appended claims to cover all such alternative aspects as fall within the true spirit and scope of the invention.

What is claimed:

1. A lift for raising a vehicle relative to the ground and for supporting the vehicle in a raised position, comprising:

a support column standing vertically upward from the ground;

a carriage attached to said support column, said carriage adapted for vertical movement relative to said support column;

a pair of arms pivotally attached to said carriage, each of said pair of arms being adjustable lengthwise; and a pair of wheel engaging adapters, each one of said pair of wheel engaging adapters being pivotally attached to a free end of one of said pair of arms and being configured to receive therein and support thereon a tire of said vehicle when in said raised position; and wherein each of said wheel engaging adapters has a pivot end portion attached to said free end of said respective arm, said pivot end portion being spaced from a wheel engaging end portion positioned opposite said pivot end portion of said wheel engaging adapter and in which said wheel engaging end portion is rotatable in a substantially horizontal plane relative to said respective arm of said pair of arms.

2. The vehicle lift of claim 1, further comprising means for rotating each of said pair of wheel engaging adapters about a substantially vertical axis.

3. The vehicle lift of claim 2, wherein said means further comprises an actuator for rotating each of said wheel engaging adapters.

4. The vehicle lift of claim 3, wherein said actuator is a handle for manually rotating each of said wheel engaging adapters.

5. The vehicle lift of claim 1, wherein each of said pair of wheel engaging adapters comprises a first contact surface and a second contact surface, said first and second contact surfaces being separated by distance, said first and second contact surfaces each having a portion extending longitudinally in substantially parallel relationship to the portion of the other.

6. The vehicle lift of claim 5, further comprising means for adjusting the distance between said first and second contact surfaces.

7. The vehicle lift of claim 6, wherein said means for adjustment comprises a removable attachment unit slidably attachable to said wheel engaging adapter.

8. The vehicle lift of claim 5, wherein a free end of said first and second contact surfaces are tilted upwards so as to prevent sagging while a vehicle is being lifted thereon.

9. A wheel engaging vehicle lift for a vehicle, comprising:

a pair of support columns;

a pair of carriages, each of said pair of carriages movably attached to a corresponding one of said pair of support columns, each of said pair of carriages being moveable relative to said corresponding one of said pair of support columns;

a pair of arms extending away from each of said pair of carriages, each of said pair of arms having a first end and a second end; and a pair of wheel engaging adapters, each of said pair being removably secured proximate to said second end of one of said arms, each of said wheel engaging adapters being pivotable about a substantially vertical axis and being configured to receive therein and support thereon a tire of said vehicle when in a raised position, and wherein each of said wheel engaging adapters has a pivot end portion attached to said second end of said respective arm, said pivot end portion being spaced from a wheel engaging end portion positioned opposite said pivot end portion of said wheel engaging adapter and in which said wheel engaging end portion is rotatable about said substantially vertical axis in a substantially horizontal plane relative to said respective arm of said pair of arms.

10. The vehicle lift of claim 9, further comprising means for rotating said adapter about said substantially vertical axis.

11. The vehicle lift of claim 10, wherein said means for rotating comprises a handle for manual rotation.

12. The vehicle lift of claim 9, wherein said wheel engaging adapter comprises a first contact surface and a second contact surface, said first and second contact surfaces being separated by distance, said first and second contact surfaces having a portion extending longitudinally in substantially parallel relationship to the portion of the other.

13. The vehicle lift of claim 12, further comprising means for adjusting the distance between said first and second contact surfaces.

14. The vehicle lift of claim 13, wherein said means for adjustment comprises a removable attachment unit slidably attachable to said wheel engaging adapter.

15. The vehicle lift of claim 12, wherein a free end of said first and second contact surfaces are tilted upwards so as to prevent sagging while a vehicle is being lifted thereon.

16. A vehicle lift for a vehicle, comprising:

first and second support columns;

first and second carriages, said first carriage movably attached to said first support column and said second carriage movably attached to said second support column;

a first pair of arms extending away from said first carriage and a second pair of arms extending away from said second carriage, said first and second pairs of arms each having a first end and a second end, said first and second pairs of arms each being rotatable about a substantially vertical axis proximate to said first end; and a pair of wheel engaging adapters, each of the pair being removably secured proximate to one of said second ends of said first and second pairs of arms, each of said wheel engaging adapters being rotatable about a substantially vertical axis proximate to said second end and being configured to receive therein and support thereon a tire of said vehicle when in a raised position; and wherein each of said wheel engaging adapters has a pivot end portion attached to said second end of said respective arm, said pivot end portion being spaced from a wheel engaging end portion positioned opposite said pivot end portion of said wheel engaging adapter and in which said wheel engaging end portion is rotatable about said substantially vertical axis of said second end in a substantially horizontal plane relative to said respective arm of said pair of arms.

17. The vehicle lift of claim 16, wherein said wheel engaging adapter comprises a first contact surface and a second contact surface, said first and second contact surfaces being separated by distance, said first and second contact surfaces having a portion extending longitudinally in substantially parallel relationship to the portion of the other.

18. The vehicle lift of claim 17, further comprising means for adjusting the distance between said first and second contact surfaces.

19. The vehicle lift of claim 18, wherein said means for adjustment comprises a removable attachment unit slidably attachable to said wheel engaging adapter.

20. The vehicle lift of claim 17, wherein a free end of said first and second contact surfaces are tilted upwards so as to prevent sagging while a vehicle is being lifted.

* * * * *